US005524703A

United States Patent [19]

Landua et al.

[11] Patent Number: 5,524,703

[45] Date of Patent: Jun. 11, 1996

[54] APPARATUS FOR SHOOTING FOUNDRY CORES OR MOLDS WITH MOLDING MATERIALS

[75] Inventors: Werner Landua; Jürgen Müller, both of Mannheim, Germany

[73] Assignee: Adolf Hottinger Maschinenbau GmbH, Mannheim, Germany

[21] Appl. No.: 302,804

[22] PCT Filed: Jan. 30, 1993

[86] PCT No.: PCT/DE93/00074

§ 371 Date: Sep. 15, 1994

§ 102(e) Date: Sep. 15, 1994

[87] PCT Pub. No.: WO93/18874

PCT Pub. Date: Sep. 30, 1993

[30] Foreign Application Priority Data

Mar. 18, 1992 [DE] Germany ..... 42 08 647.7

[51] Int. Cl.[6] ..... B22C 15/24

[52] U.S. Cl. ..... 164/200; 164/201

[58] Field of Search ..... 164/200, 201, 164/202, 19, 20, 21, 22

[56] References Cited

U.S. PATENT DOCUMENTS

| | | | |
|---|---|---|---|
| 3,089,207 | 5/1963 | Miller | 164/22 |
| 5,052,465 | 10/1991 | Eraña | 164/200 |

FOREIGN PATENT DOCUMENTS

| | | |
|---|---|---|
| 0218496 | 4/1987 | European Pat. Off. . |
| 2422407 | 12/1974 | Germany . |
| 2194745 | 3/1988 | United Kingdom . |
| WO87/05240 | 9/1987 | WIPO . |

OTHER PUBLICATIONS

Patent Abstracts of Japan, vol.4., No. 143, JP, A, 55 097 845, Appl. No. 54–5381, Jul. 25, 1980.

*Primary Examiner*—Richard K. Seidel
*Assistant Examiner*—Randolph S. Herrick
*Attorney, Agent, or Firm*—Bell, Seltzer, Park & Gibson

[57] ABSTRACT

A device for shooting foundry cores with molding materials (1), comprising a shooting head (4) with an inlet side (2) and an outlet side (3), a shooting plate (6) located at the outlet side of the shooting head (4) and accommodating at least one shooting nozzle (5), and a clamping head (7) associated to the shooting head (4) on its inlet side and having at least one air supply (8) for a leakproof application of compressed air to the shooting head (4), the clamping head being preferably vertically movable by means of a cylinder-piston arrangement (9), is designed and constructed for purposes of avoiding local air currents or making the air flow more uniform during core shooting in such a manner that a device (10) for swirling or uniformly distributing the compressed air that flows from the air supply (8) into the shooting head (4) is arranged between the shooting head (4) and the clamping head (7).

21 Claims, 2 Drawing Sheets

APPARATUS FOR SHOOTING FOUNDRY CORES OR MOLDS WITH MOLDING MATERIALS

BACKGROUND OF THE INVENTION

This invention relates to an apparatus for shooting foundry cores or molds with molding materials, the apparatus comprising a shooting head with an inlet side and an outlet side, a shooting plate associated to the shooting head and containing at least one shooting nozzle, and a clamping head associated to the shooting head on its inlet side and having at least one air supply for a leakproof application of compressed air to the shooting head, the clamping head being movable by means of a cylinder-piston arrangement.

In the foundry practice, core shooting heads have been known for many years. For casting molded products, the foundry cores and molds are molded of core sand separately in most cases, then combined and joined to one another to from a foundry mold. An essential component of the core-shooting machines are the so-called shooting heads with shooting plates accommodating the shooting nozzles. It has been common practice to fill the core sand, i.e. quartz sand compounded or coated with binding agents, into the shooting heads in question, whence it is blown or shot under a very high air pressure through nozzles arranged in the shooting plate into the respective molds.

Known per se from DE-OS 23 04 564 is an apparatus for automatically making molds and cores for use in foundries, in which the molding sand is injected into the shooting head, together with the compressed or shooting air necessary for the shooting, from a vertically rigidly mounted hopper. The compressed air enters via a connection laterally arranged on the shooting head directly into the interior of the shooting head, the connection for the compressed air being provided on the side of the shooting head. As it enters, the compressed air swirls the sand falling into or being already in the shooting head, so that local turbulences occur within the shooting head. After its entry into the shooting head, the compressed air impacts upon the opposite wall of the shooting head, whence it is deflected and redirected toward the sand.

Accordingly, the compressed-air supply occurs in an uncontrolled manner, inasmuch as a controlled, homogeneous biasing of the sand with compressed air is absent within the shooting head. The "compressed-air jets" locally occurring in the known apparatus drill, so to speak, holes into the sand being in the shooting head, or even cause the sand to precompact locally, which in most cases has already been mixed or coated with binding agents. As a result of this inhomogeneous injection of compressed air and premature compacting, it is therefore necessary to increase again the pressure necessary for the shooting.

Thus, as in the above-described apparatus of the prior art, there exists the risk that the molding sand is unintentionally precompacted already in the shooting head, so that substantial pressures are needed for the actual shooting. Moreover, the molding sand already accelerated by the shooting air drops from a considerable height into the shooting head, thereby tending to create an unwanted, premature compacting as a result of its own weight, and causing an uneven distribution of the molding sand in the shooting head.

The apparatus known from practice, or at least in part from DE-OS 23 04 564 is however also problematic, inasmuch as upon completion of the core shooting process, it requires that the clamping head be separated from the shooting head, so as to permit sand to be reloaded via a corresponding hopper device or the like. Upon opening the shooting head or one of the valves associated with the shooting head, the compressed air remaining in the shooting head escapes suddenly therefrom, and entrains to the outside of the shooting head not only suspended particles, but also sand particles, miniature particles and free resins. As a consequence thereof, the surrounding of the apparatus in question is polluted or contaminated on the one hand, and surrounding machine parts are subjected to an increased, abrasive wear by the backflow of particles. Likewise, it is possible that sand particles, as they flow back, enter into the valve area supplying the compressed air, and even into the pump region, and contribute there to wear, or even to damage.

Essential in the known apparatus in question is by all means that as a result of the uncontrolled situation within the shooting head, it has until now been absolutely necessary to shoot under high and, if need be, pulsating air pressures, whereby the sand exiting from the shooting nozzles always impacts upon walls of the mold to be filled and has there an extremely abrasive effect. Stated otherwise, the shooting nozzles operate in the sense of a sand blasting gun, so that the core sand exiting under a high pressure successively damages the mold to be filled or changes it in its geometry. Both particles separated from the mold and split core sand or separated synthetic resins are carried to the outside of the shooting head in a disadvantageous manner, after completion of the core shooting, when the shooting head is opened or ventilated.

A further disadvantage of core shooting under high air pressure can be seen in that the high air pressures cause the core sand to compact in the region of its injection already when it is shot into the mold. As a consequence, a form-locking filling of the mold is precluded, in particular in the case of complicated geometries, or, in the least, substantial gradients of density develop.

Furthermore, the high air pressures and the resultant heavy impact of the sand upon the walls of the particular mold cause a binding agent adhering to the sand to blast off or separate, and last not least a nonuniform distribution of sand and binding agents will occur as a result of differences in the density between the sand and binding agents. Gases which are released at high temperatures from concentrations of binding agents prevent again a uniform compacting or the formation of a flawless core.

Finally, in the conventional core shooting practice a serious problem lies in that the shooting heads are filled beyond the absolutely necessary measure regardless of the volumes of the cores to be shot. Consequently, it is necessary to blast the compressed air required for the shooting, even when the dimensions of the cores to be shot are very small, through the sand deposit in the shooting head, or to accelerate the core sand particles which lie directly against the shooting nozzles. A substantial volume of sand in the shooting head is therefore absolutely necessary, also for the reason that the compressed air flowing into the shooting head in an uncontrolled manner drills, at least in part, holes into the sand, and upon reaching the shooting plate of the nozzles arranged therein, largely prevents an exiting, i.e. a shooting of the core sand. On the one hand, the large dimensions of the shooting heads as are required for shooting large cores, and on the other hand the substantial volume of core sand that needs to be penetrated by the compressed air, however, make it absolutely necessary to apply the high and, if need be, even pulsating pressures which have previously been found to be extremely disadvantageous.

It is therefore the object of this invention to provide an apparatus for shooting foundry cores or molds with molding materials, which allows to apply compressed air at least largely uniformly to the molding materials located in the shooting head.

SUMMARY OF THE INVENTION

The above and other objects and advantages of the present invention are achieved by the provision of an apparatus for shooting foundry cores or molds with molding materials, and which comprises a shooting head, a shooting plate associated with the outlet side of the shooting head, and a clamping head associated with the shooting head on its inlet side. At least one air supply is provided for delivering compressed air to the shooting head, and an air distribution member or diffuser is provided in the flow path of the compressed air and between the shooting head and the clamping head and which includes openings for substantially uniformly distributing the compressed air flowing from the air supply into the shooting head.

To begin with, it has been recognized in accordance with the invention that the compressed air flowing directly into the shooting head leads to undesired, local "incisions", or even to local compactions. Consequently, an apparatus is provided in accordance with the invention, which swirls or evenly distributes the inflowing compressed air in the shooting head in direction toward the molding material. Further, in accordance with the invention, this apparatus is provided between the shooting head and the clamping head, so that a double function is assigned to the apparatus in question, namely, on the one hand to swirl or uniformly distribute the air flowing from the air supply into the shooting head, and on the other hand to screen or filter the air possibly flowing back from the shooting head into the clamping head, or thence through the air supply into a compressor, or a pump, or the like. Consequently, in accordance with the invention, the shooting operation is favored to the extent that as a result of the uniform distribution of the compressed air within the shooting head, lower pressures are required for the shooting. On the other hand, an undesired backflow of particles, suspended particles, or the like, and thus an abrasive wear of structural components preceding the shooting head effectively reduced, if not even eliminated.

With respect to a specific, technical configuration of the apparatus for swirling or uniformly distributing compressed air flowing from the air supply into the shooting head, the latter is provided in particularly advantageous manner with an air distribution member which may basically be a filter of any kind, it being only necessary to ensure by the filter that a higher pressure builds up on the pressure side preceding the filter than in the shooting head following the filter. This increase in pressure before the filter leads to a uniform "penetration" of the compressed air through the filter, so that as a result the compressed air is uniformly distributed within the subsequent pressure head.

In a further advantageous manner, the filter may be designed as a streamline filter with openings preferably extending parallel to one another. Such a streamline filter may in this instance be, for example, a finely slotted plate, with the slots or gaps extending quasi diagonally from the one edge region of the filter to the other. In a further advantageous manner, the gaps in question may be spaced 10 to 15 mm apart from one another. Preferably the spacing between gaps is about 12 mm. To ensure that these gaps cause indeed an air buildup on the inflow side and, thus, a higher pressure than on the outflow side, the gaps have a width from about 30 to 60 μm. The gap width may also easily vary, with a larger design of the gap width leading to a pressure drop on the inflow side, which becomes disadvantageous for a uniform distribution of compressed air within the shooting head. Substantially narrower designed gaps will make it necessary to increase the air pressure on the inflow side, so that the air pressure building up downstream of the filter is adequate for shooting the cores. Otherwise, it is necessary to see to it that the gap width is selected as a function of the molding material in use only in such a manner that the gaps are not clogged by the molding material or sand, when the compressed air flows back.

Within the scope of a special embodiment, the gaps extend substantially parallel to one another, i.e., they are evenly spaced apart from one another at any point of the filter. Likewise however, it would also be conceivable that the gaps diverge and approach one another, so as to achieve specific flow characteristics. Furthermore, it is possible that the gaps of the filter diverge on the inflow side, so that the cross members extending between the gaps taper toward the inflow side. In other words, on the inflow side the gaps are provided with an inflow region configured in a way similar to a funnel, so that the flow resistance caused by the cross members is effectively minimized.

The gaps or the cross members separating the gaps may be arranged, so that the gaps cause the compressed air to enter into the shooting head substantially in axial direction. Likewise, it would be possible for purposes of generating a certain flow pattern to provide the filter with uniformly or differently inclined gaps, so as to achieve a certain distribution of the compressed air. The angles of inflow to be provided in this instance could each be adapted to the corresponding shooting head. Furthermore, this measure permits to configure the filter with a smaller diameter than the opening of the shooting head, it being possible to still achieve with a certain inclination of the gaps that compressed air is applied to entire interior space of the shooting head.

Within the scope of a further advantageous embodiment the filter may have a thickness, which corresponds to the spacing of the gaps, i.e., the thickness of the cross members between the gaps. Consequently, a thickness of 10 to 15 mm would result, in particular a thickness of 12 mm. This would ensure that, with the use of corresponding materials, the filter exhibits an adequate stability in the path of the compressed air. A material to be considered would be stainless steel, preferably a high-quality steel. In particular, because of the aggressiveness of the binding agents, the use of stainless steel is of special advantage.

For purposes of reliably securing or clamping the filter between the clamping head and the shooting head, it will be of quite a special advantage, when the filter is held by a ring substantially adapted to the shooting head or the clamping head. This ring serving as a holder could be releasably connected either to the shooting head or to the clamping head. A releasable connection of the ring, and thus of the filter, to the clamping head will however be of advantage, inasmuch as it would allow to remove the filter together with the clamping head for refilling the shooting head with core sand. An additional operation to remove the filter would thus become unnecessary in a very particularly advantageous manner.

The ring serving to receive the filter could specifically be constructed such that the filter would be inserted into a cutout provided in the inner edge of the ring or be secured by resting against the bottom the cutout in the edge. Thus, the filter would be totally sunk into the ring, and damage to the filter by inexpert handling would be largely avoided at least in the edge region.

For purposes of further securing and supporting the filter, the ring could be provided with a support rib extending diagonally approximately in its center. In an advantageous manner, this support rib would extend with the bottom of the edge cutout in one plane, so that the filter inserted into the edge cutout lies on the support rib and on the bottom of the edge cutout.

Likewise, it would be possible to provide the clamping head on its side facing the shooting head with a rib formed approximately in its center, or a least a corresponding eye, so that in its installed condition the filter would be locked in position between the support rib of the ring and the rib of the clamping head. This would allow to adequately protect the filter against deformation or displacement both when compressed air flows in and when compressed air and possibly particles flow back.

To prevent the ring located between the clamping head and the shooting head from causing a pressure loss, the ring is provided, both on its side facing the clamping head and on its side facing the shooting head with seals, which seal on the one hand between the ring and the clamping head and on the other hand between the ring and the shooting head. These seals may be, for example, conventional gaskets or O-rings, which are squeezed when the clamping head is pressed onto the shooting head, and thus seal in an effective manner.

As regards a uniform distribution of compressed air inside the shooting head, it will be of further advantage, when at least two air supplies separated from one another are provided, which enter at different points via the clamping head into the shooting head. Advantageously, the air supplies are connected to the clamping head on its outer edge portion. The air supplies are constructed in the form of tubes, which extend substantially along the clamping head, or along the vertical direction of movement of the clamping head. The air supplies or tubes are fixedly connected to the clamping head and form an additional guideway of the clamping head for its vertical movement. To this end, the tubes themselves again extend in known manner or are supported accordingly.

The compressed air flowing first into the clamping head and thence into the shooting head is deflected, via connectors following the air supplies or tubes, transversely to the clamping head into its region facing the shooting head. This region is open toward the shooting head, so as to permit the compressed air which has reached this region to enter unobstructed through the filter into the shooting head. The connectors deflect the compressed air advancing from the air supplies by about 90°, i.e., the air flows into the clamping head transversely to its vertical direction of movement.

Furthermore, it is essential that within the scope of a particularly advantageous embodiment, the region of the clamping head facing the shooting head is surrounded by an edge portion projecting downward therefrom toward the shooting head. In this arrangement, the connectors are parts of or integral with the edge portion. In other words, the clamping head with its edge portion forms a kind of hood, which is bordered by the ring with the filter inserted therein.

Finally, it is of quite a special advantage, when portions of the connectors subjected to an increased abrasive wear, i.e., the portions directly contacted by the flow of the compressed air, are constructed as exchangeable replacement parts. These are in particular those portions of the connectors, which form, when viewed in the direction of flow, the outer curved walls, which are always directly contacted by the flow medium.

There exist various possibilities of perfecting and further developing the teaching of the present invention in an advantageous manner. To this end, reference may be made to the following description of an embodiment of the invention with reference to the drawing. In conjunction with the description of the preferred embodiment of the invention with reference to the drawing, also generally preferred embodiments and further developments of the teaching are described in more detail.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION OF THE PREFERRED EMBODIMENT

Figure 1:
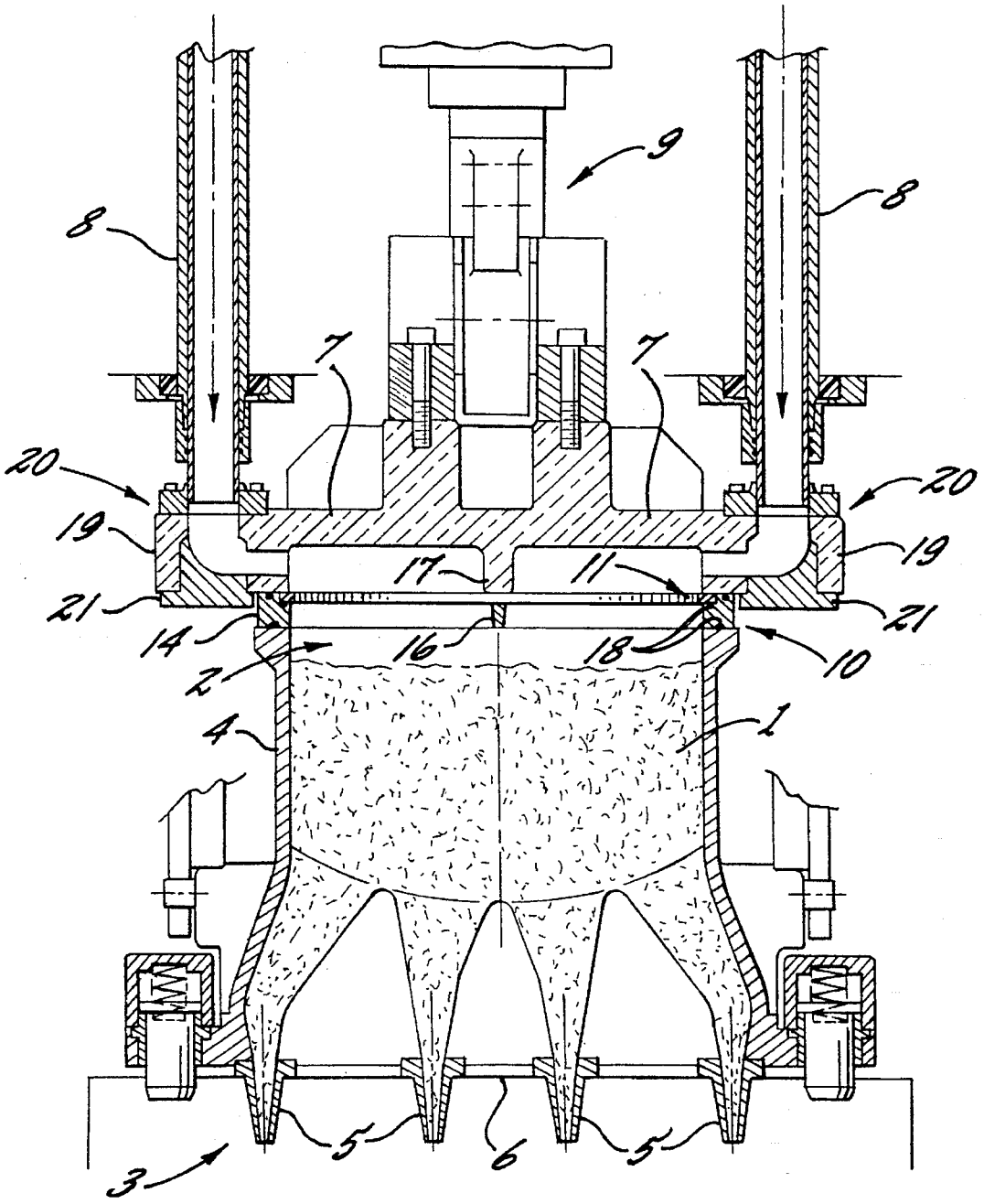
FIG. 1 is a schematic sectional side view of an embodiment of an apparatus designed in accordance with the invention for shooting foundry cores or molds with molding materials, the apparatus being shown in its operating position.

Shown in FIG. 1 is an embodiment of an apparatus in accordance with the invention for shooting foundry cores or molds with molding materials or molding sand 1. The apparatus of the present invention is provided with a shooting head 4 having an inlet side 2 and an outlet side 3. Associated with the shooting head 4 on its outlet side is a shooting plate 6 accommodating shooting nozzles 5. On its inlet side, shooting head 4 is associated with a clamping head 7, which is again provided with an air supply 8. Among other things, the clamping head serves to ensure a leakproof application of compressed air to shooting head 4, the clamping head 7 being vertically movable by means of a cylinder-piston arrangement 9.

In accordance with the invention, a device 10 for swirling or evenly distributing compressed air flowing from air supply 8 into shooting head 4 is provided between shooting head 4 and clamping head 7. In the here selected embodiment, the device 10 for swirling or evenly distributing the compressed air comprises an air distribution member or filter 11, more specifically as a streamline filter.

Figure 2:
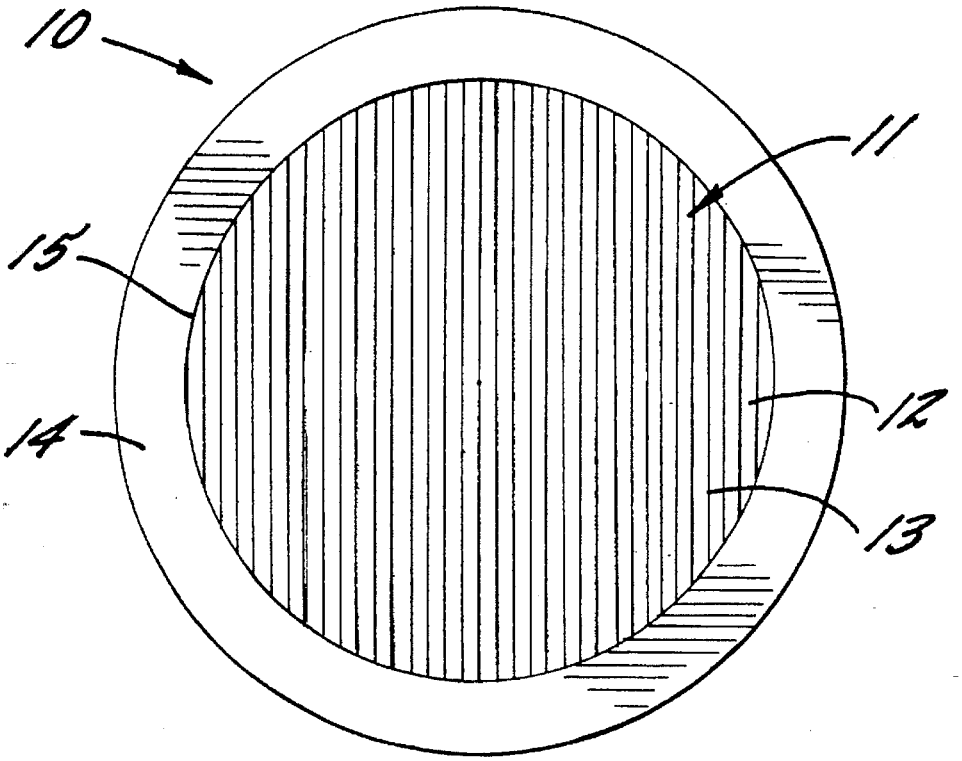
FIG. 2 is a schematic top view of the filter of FIG. 1 inserted or secured in a ring.
Figure 3:
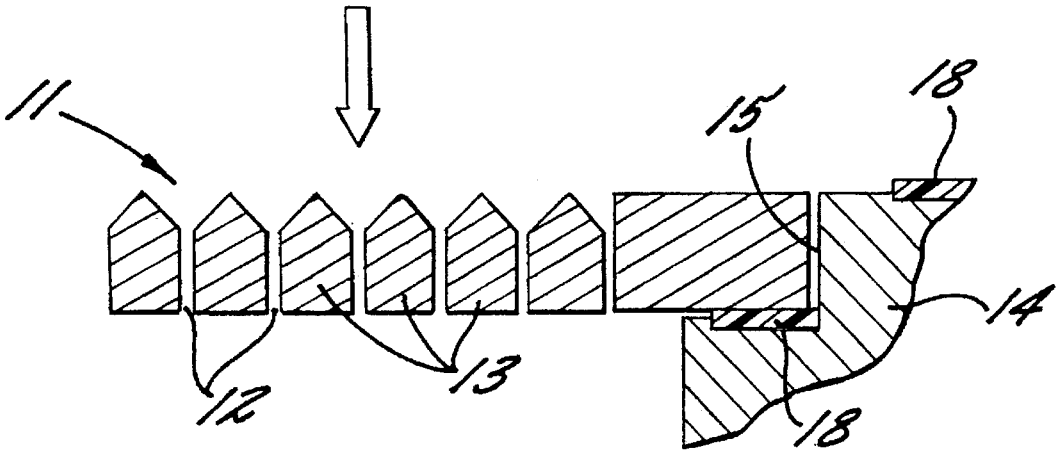
FIG. 3 is an enlarged sectional side view showing a portion of the filter of FIG. 2.

As best seen in FIGS. 2 and 3, the filter 11 which is designed and constructed as a streamline filter, comprises gaps 12 extending parallel to one another. These gaps 12 are spaced 12 mm apart from each other. The gaps 12 themselves measure approximately 30 to 60 μm wide. The gaps 12 extend substantially parallel to one another and diverge toward the inflow side such that the cross members 13 between the gaps 12 taper toward the inflow side (note FIG. 3).

As can further be noted from both FIGS. 2 and 3, the gaps 12 cause the compressed air to enter into the shooting head 4 substantially in an axial direction. Any other desired angle differing from gap to gap would be conceivable. The filter 11 itself has a thickness of approximately 12 mm and is made of a high-quality steel.

As can be noted from both FIGS. 1 and 2, the filter 11 is held by a ring 14 substantially adapted to clamping head 7, and the ring 14 is releasably connected with clamping head 7. The ring 14 is provided on its inner edge with a cutout 15 which secures filter 11 resting thereagainst.

The ring 14 further mounts a support rib 16 which extends diagonally approximately in the center thereof, and is shown in cross sectional view in the illustration of FIG. 1. The support rib 16 extends from the bottom of edge cutout 15 in one plane, so that the filter inserted into edge cutout 15 rests against support rib 16 and against the bottom of edge cutout 15.

Furthermore, on it side facing shooting head 4, the clamping head 7 is provided with a rib 17 formed approximately in its center, so that the filter 11 is secured between support rib 16 of ring 14 and the rib 17 of clamping head 7.

Further shown in FIG. 1 is that ring 14 is provided both on its side facing clamping head 7 and on its side facing shooting head 4 with gaskets 18 which seal on the one hand between ring 14 and clamping head 7, and on the other hand between ring 14 and shooting head 4.

For a more uniform supply of air, two space-apart air supplies 8 are provided, which are connected to clamping head 7 on its outer edge portion. The air supplies 8 are tubular and extend substantially along clamping head 7. They are fixedly connected to clamping head 7 and additionally guide same in its vertical movement.

The compressed air is deflected by means of deflectors 19 subjacent to air supplies 8, so as to flow transversely to clamping head 7 in its region facing shooting head 4. The deflectors 19 deflect the compressed air advancing from air supplies 8 by approximately 90°.

The region of clamping head 7, which faces shooting head 4, is surrounded by an edge portion 20 projecting downward toward shooting head 4, with deflectors 19 forming parts of this edge portion 20. In this arrangement, portions of deflectors 19 which are subjected to increased abrasive wear, i.e. portions directly exposed to the flow of the compressed air, are designed and constructed as exchangeable replacement parts 21.

Finally, it should be emphasized that the gist of the present invention, namely a uniform application of compressed air to molding materials located inside the shooting head, so as to effectively reduce the necessary air pressure during the core shooting operation, may also be realized in other concrete embodiments consisting of a shooting head and a clamping head. The foregoing embodiment is described by way of an example, and serves exclusively for an understanding of the teaching in accordance with the invention, without however limiting same.

What is claimed is:

1. Apparatus for shooting foundry cores or molds with molding materials (1), comprising a shooting head (4) with an inlet side (2) and an outlet side (3), a shooting plate (6) associated with the outlet side of shooting head (4) and accommodating at least one shooting nozzle (5), and a clamping head (7) associated with the shooting head (4) on its inlet side and comprising at least one air supply (8) for delivering compressed air to the shooting head (4), and an air distribution member comprising a frame with a plurality of parallel slots (11) provided in the flow path of the compressed air and arranged between the shooting head (4) and the clamping head (7) and including openings defined by said slots (12) for distributing the compressed air flowing from the air supply (8) into the shooting head (4).

2. Apparatus as in claim 1, characterized in that the openings (12) are in the form of slots which extend parallel to each other and are spaced 10 to 15 mm apart from one another.

3. Apparatus as in claim 2, characterized in that the slots are spaced about 12 mm apart from one another.

4. Apparatus as in claim 1, characterized in that the openings (12) have a width from 30 to 60 μm.

5. Apparatus as in claim 1, characterized in that the openings (12) are defined between a plurality of cross members (13) which extend substantially parallel to one another, said cross members each having a cross section on their upstream side of an inverted V and so that the openings coverage in the downstream direction.

6. Apparatus as in claim 1, characterized in that the openings (12) are configured so as to cause the compressed air to enter into the shooting head substantially in an axial direction.

7. Apparatus as in claim 1, characterized in that the openings (12) are configured so as to cause the compressed air to enter into shooting head (4) at a common angle or at several different angles.

8. Apparatus as in claim 1, characterized in that the air distribution member (11) has a thickness of approximately 12 mm.

9. Apparatus as in claim 1, characterized in that the air distribution member is made of stainless steel.

10. Apparatus as in claim 1, characterized in that the air distribution member (11) is supported by said frame which comprises a ring (14) which is mounted between the shooting head (4) and the clamping head (7).

11. Apparatus as in claim 10, characterized in that the ring (14) is provided on its side facing clamping head (7) and on its side facing shooting head (4) with seals (18), with one seal positioned between the ring (14) and the clamping head (7) and with another seal positioned between the ring (14) and the shooting head (4).

12. Apparatus as in claim 10, characterized in that the air distribution member (11) is supported in an annular cutout (15) provided in the inner edge of the ring (14).

13. Apparatus as in claim 12, characterized in that the annular cutout (15) defines a planar bottom edge which engages the air distribution member (11) and wherein the ring (14) is provided with a support rib (16) extending diagonally across approximately the center of the ring, with the support rib (16) having an upstream edge which is co-planar with said bottom edge so that the air distribution member rests against the support rib (16) and against the bottom edge of the annular cutout (15).

14. Apparatus as in claim 12, characterized in that the clamping head (7) is provided on its side facing shooting head (4) with a rib (17) formed approximately in its center, and that the air distribution member (11) is secured in position between the support rib (16) and the rib (17) of clamping head (7).

15. Apparatus as in claim 1, characterized in that the clamping head (7) is mounted to said shooting head (4) for relative vertical movement by means of a cylinder-piston assembly (9).

16. Apparatus as in claim 15, characterized in that at least two spaced-apart air supplies (8) are provided, with the air supplies (8) being connected to the clamping head (7).

17. Apparatus as in claim 16, characterized in that the air supplies (8) are constructed in the form of tubes, which extend substantially vertically along said clamping head (7) and are fixedly connected to clamping head (7), and means slideably supporting the tubes so that the tubes additionally guide the clamping head (7) in its vertical movement.

18. Apparatus as in claim 16, characterized in that the clamping head (7) mounts an air deflector (19) connected to each of said air supplies (8) for deflecting the delivered air transversely to the clamping head (7) at a location immediately, upstream of said air distribution member (11).

19. Apparatus as in claim 18, characterized in that the deflectors (19) are configured to deflect the compressed air advancing from the air supplies (8) by about 90°.

20. Apparatus as in claim 18, characterized in that the region of the clamping head (7) adjacent the shooting head (4) is surrounded by an edge portion (20) projecting downward in a direction toward the shooting head (4), and that the deflectors (19) form parts of or are integral with the edge portion (20).

21. Apparatus as in claim 20, characterized in that at least the portions of the deflectors (19) which are exposed to abrasive wear resulting from the flow of compressed air, are constructed as exchangeable replacement parts (21).

* * * * *